US012397880B1

(12) United States Patent
Leslie et al.

(10) Patent No.: US 12,397,880 B1
(45) Date of Patent: Aug. 26, 2025

(54) ACCESSORY ATTACHMENT SYSTEM

(71) Applicants: William D Leslie, Bradenton, FL (US); Bradley J Kapper, Bradenton, FL (US)

(72) Inventors: William D Leslie, Bradenton, FL (US); Bradley J Kapper, Bradenton, FL (US)

(73) Assignee: EQUIPMOUNT LLC, Bradenton, FL (US)

( * ) Notice: Subject to any disclaimer, the term of this patent is extended or adjusted under 35 U.S.C. 154(b) by 1143 days.

(21) Appl. No.: 16/856,769

(22) Filed: Apr. 23, 2020

(51) Int. Cl.
*B63B 17/02* (2006.01)
*B63B 17/00* (2006.01)

(52) U.S. Cl.
CPC ..... *B63B 17/02* (2013.01); *B63B 2017/0054* (2013.01)

(58) Field of Classification Search
CPC . B63B 17/00; B63B 17/02; B63B 2017/0054; B63H 21/00; B63H 21/10; A44B 1/00; A44B 1/34; A44B 17/00
USPC ..... 114/343, 361, 364; 24/103, 104, 110
See application file for complete search history.

(56) References Cited

U.S. PATENT DOCUMENTS

| | | | | |
|---|---|---|---|---|
| 4,630,982 | A * | 12/1986 | Fenner | B61D 45/001 24/701 |
| 4,637,492 | A | 1/1987 | Herr | |
| 4,966,091 | A | 10/1990 | De Suarez D'Aulan | |
| 5,124,902 | A | 6/1992 | Puglisi | |
| 5,268,824 | A | 12/1993 | Czipri | |
| 5,803,585 | A | 9/1998 | Littman et al. | |
| 5,927,847 | A | 7/1999 | Cales et al. | |
| 6,089,933 | A * | 7/2000 | Cotton | B63B 13/02 440/88 M |
| 6,186,088 | B1 | 2/2001 | Garnier et al. | |
| 7,021,236 | B1 | 4/2006 | Czipri | |
| 8,122,572 | B2 * | 2/2012 | Waddell | B63B 17/02 24/110 |
| 2008/0055905 | A1 | 3/2008 | Chiu | |
| 2016/0288887 | A1 | 10/2016 | Corley | |

* cited by examiner

*Primary Examiner* — Lars A Olson
(74) *Attorney, Agent, or Firm* — Edward M. Livingston, Esq.; LIVINGSTON LAW, P.A.

(57) ABSTRACT

An accessory attachment system for quickly attaching and removing accessories on boats, vehicles and other objects in order to allow for temporary use of the accessory or accessories for a specific activity and/or application.

14 Claims, 17 Drawing Sheets

DETAIL A

ACCESSORY ATTACHMENT SYSTEM

CROSS-REFERENCE TO RELATED APPLICATION

This application is a continuation-in-part of application Ser. No. 16/004,820 filed on Jun. 11, 2018, which is currently pending. In addition, this application claims priority to application Ser. No. 62/808,017 filed on Feb. 20, 2019, which is currently pending. The patent applications identified above are incorporated herein by reference in their entirety to provide continuity of disclosure.

FIELD OF THE INVENTION

This invention relates to boats and recreational vehicles, and more particularly a system for quickly attaching and removing accessories on boats, vehicles and other objects in order to allow for temporary use of the accessory for a specific activity and/or application.

BACKGROUND OF THE INVENTION

There are many accessories available for boats and vehicles, such as automobiles, trucks, utility vehicles, all-terrain vehicles and so forth, which are used to customize a particular boat or vehicle for a specific activity. Such accessories are mounted onto a surface of the boat or vehicle. Attachable accessories are also available for other objects, such as trailers, work benches, tables and so forth.

Attachable accessories for boats may include tie downs, towers, arches, bimini tops, fishing rod holders, seating, elevated decks, hunting blinds and so forth. Attachable accessories for vehicles may include storage racks, truck racks, utility racks, cargo carriers, tie downs, gun racks, extra seating, lights and so forth. Attachable accessories for other objects or work surface may include tools, vices, saws and so forth that are secured to a work surface prior to use.

The conventional method of installing these types of accessories is to permanently attach the accessories to a desired surface. This causes a problem if an owner wants to use a boat, vehicle or other object for multiple types of activities. For example, a boat owner may want to use a boat for fishing one weekend and then as a pleasure or cruising boat the next weekend, wherein certain accessories are not needed and will only take up space on the boat. A vehicle owner may want to use a storage rack for only the time necessary to transport cargo. Other individuals may want to temporarily secure a saw or other tool to a work surface only for the time necessary to perform a necessary task.

Therefore, a need exists for an accessory attachment system for quickly attaching and removing accessories on boats, vehicles and other objects in order to allow for temporary use of the accessory for a specific activity and/or application.

SUMMARY OF THE INVENTION

The primary object of the present invention is to provide an accessory attachment system for quickly attaching and removing accessories on boats, vehicles and other objects in order to allow for temporary use of the accessory for a specific activity and/or application.

The present invention fulfills the above and other objects by providing an accessory attachment system for boats, vehicles and other objects wherein a socket is secured to a mounting surface and a corresponding stud is attached to an accessory, such as a tie down, anchor, shackle, shade supports, support poles, utility racks and so forth. The stud may then be removeably attached to the socket. A plurality of quick connects may be used for accessories having multiple attachment points. For example, the studs may support respective poles that support a canopy for shade.

The accessory attachment system may also have a one or more mechanisms to allow for blind installations on surfaces wherein the underside of the surface is not accessible.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

Figure 4:
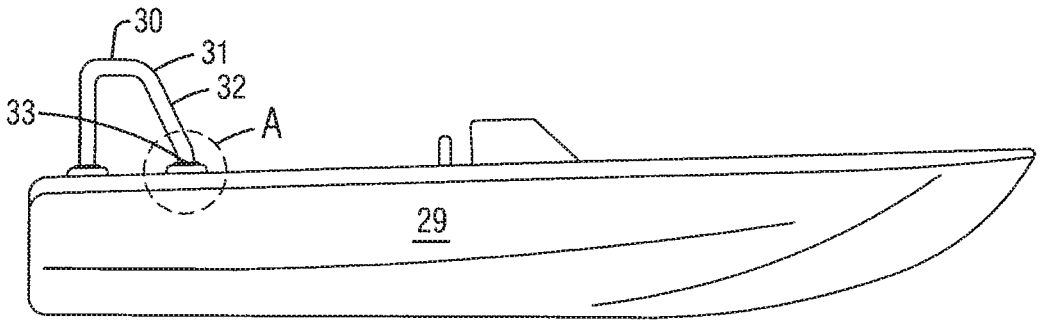
Figure 5:
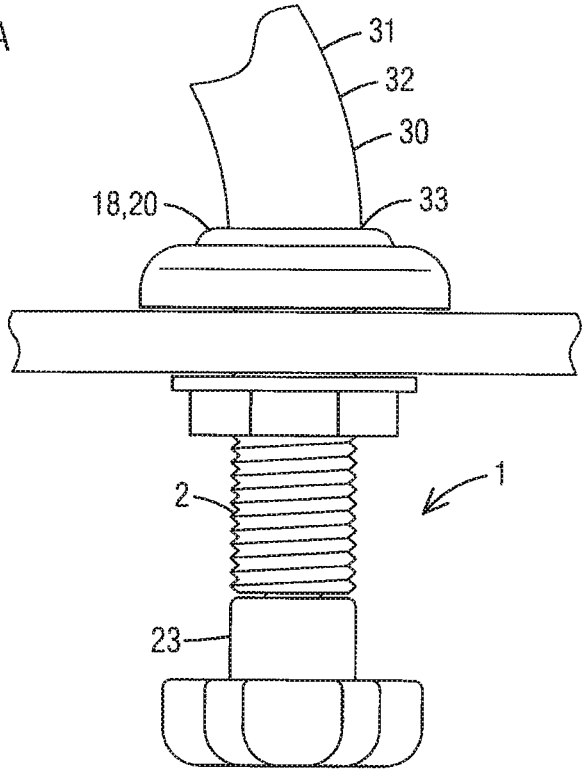
Figure 6:
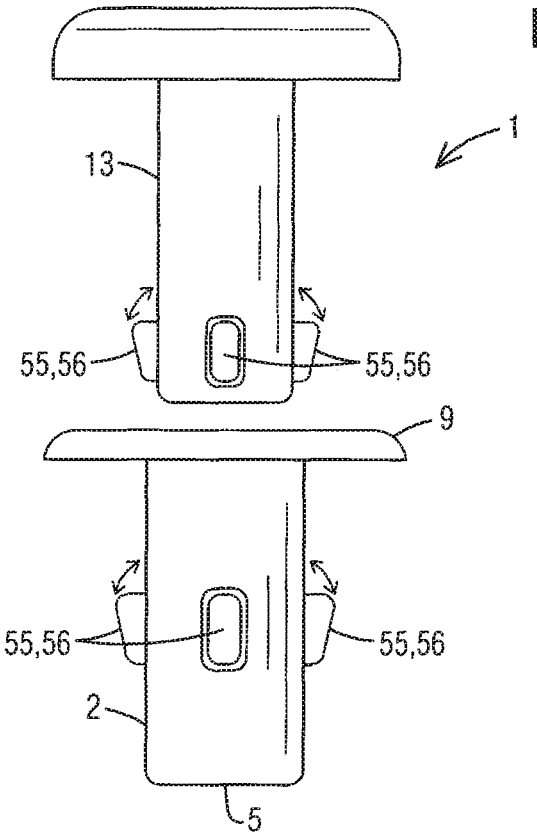
Figure 7:
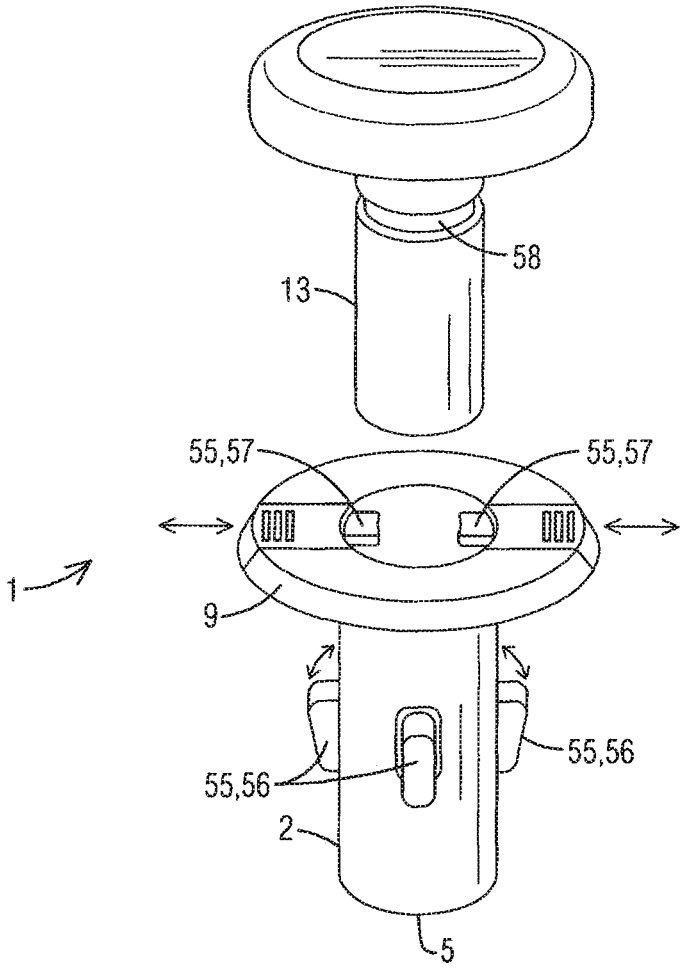
Figure 8:
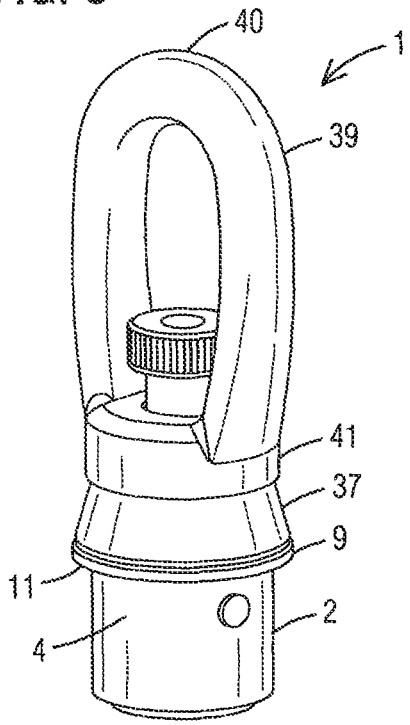
Figure 9:
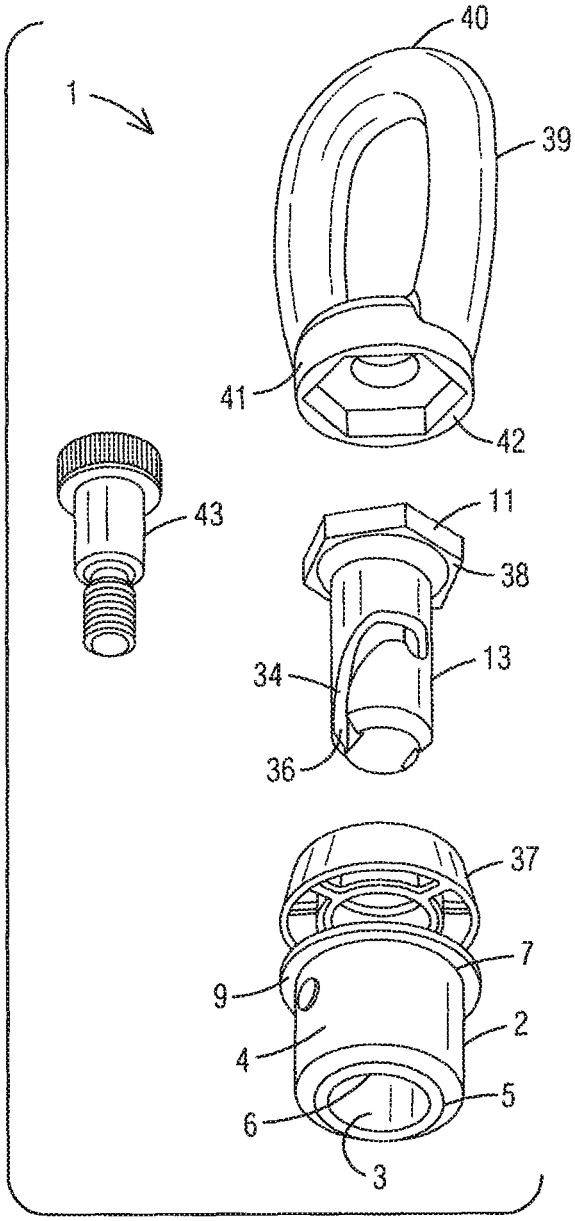
Figure 10:
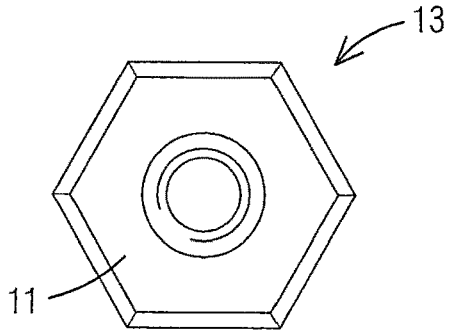
Figure 11:
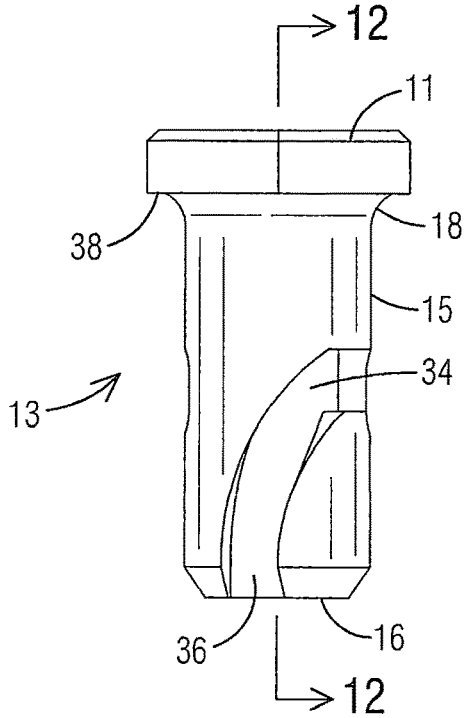
Figure 12:
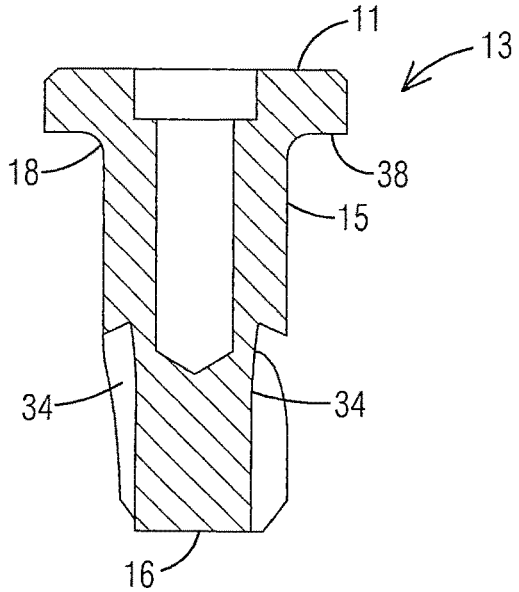
Figure 13:
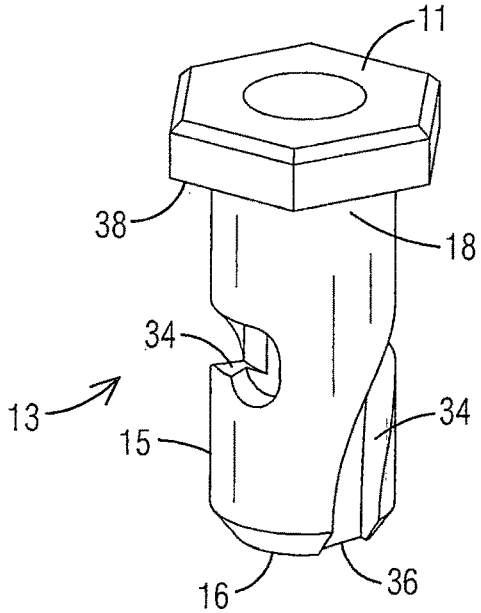
Figure 14:
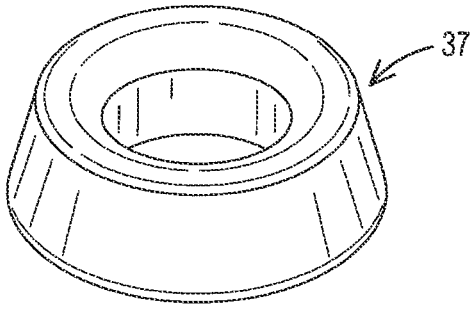
Figure 15:
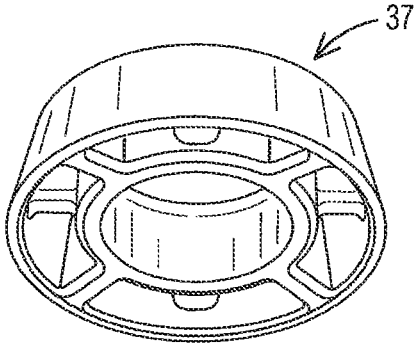
Figure 16:
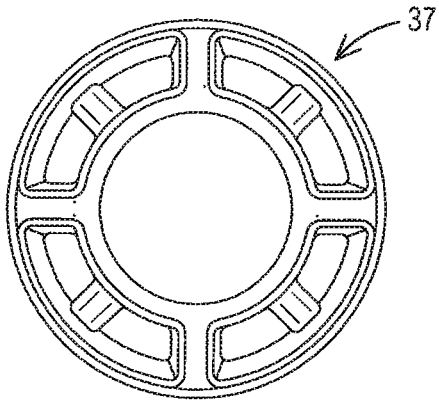
Figure 17:
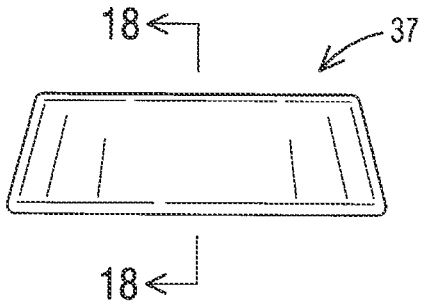
Figure 18:
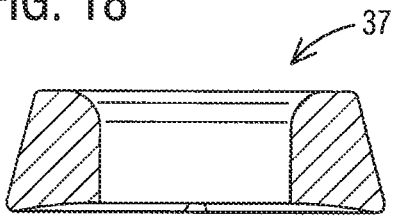
Figure 19:
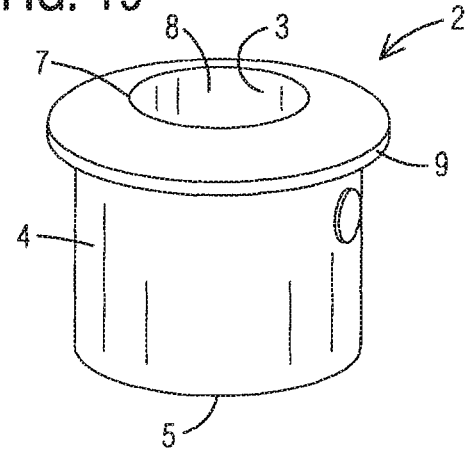
Figure 20:
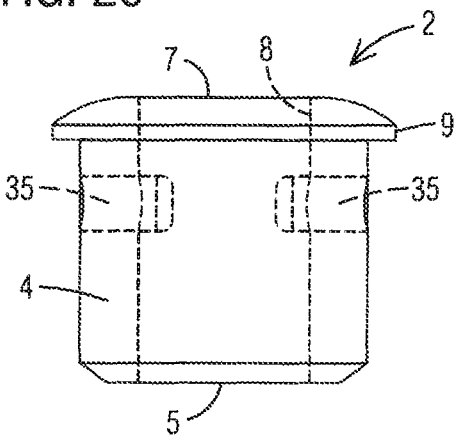
Figure 21:
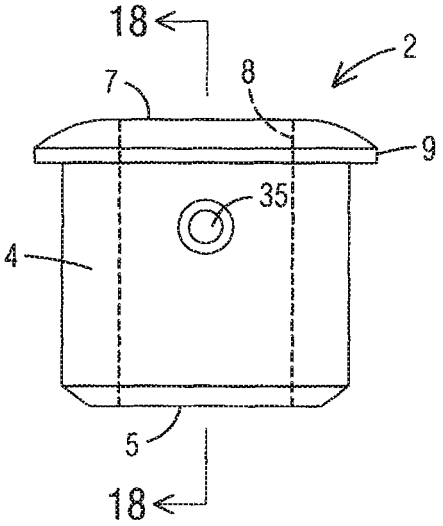
Figure 22:
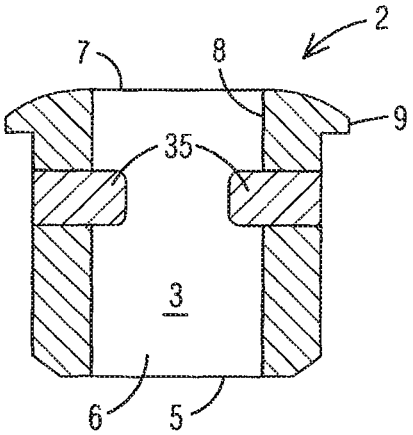
Figure 23:
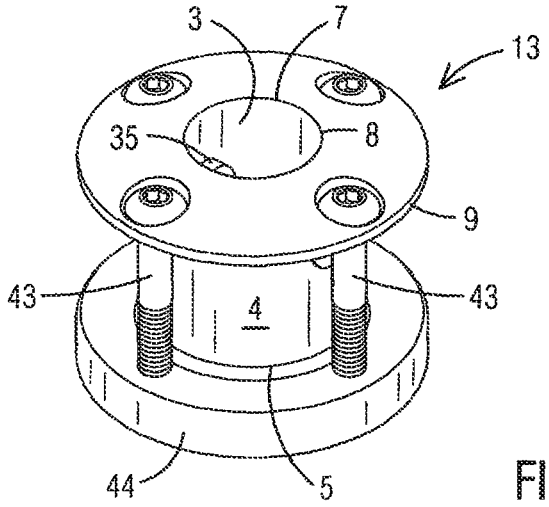
Figure 24:
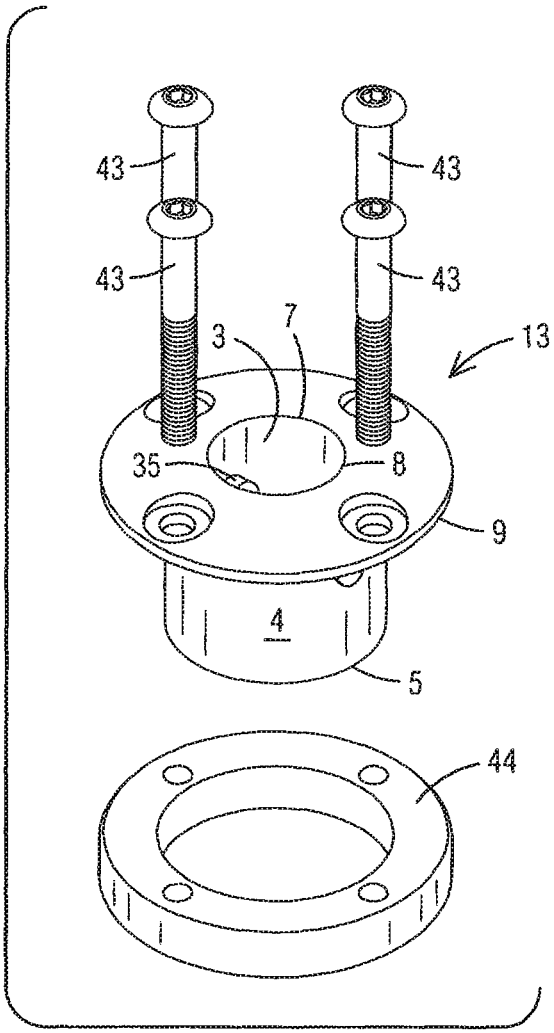
Figure 25:
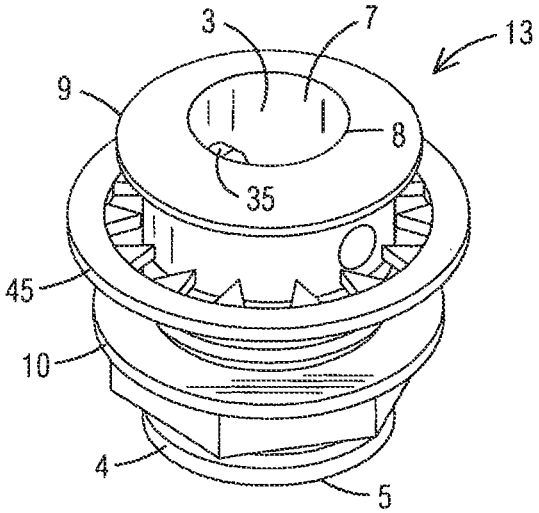
Figure 26:
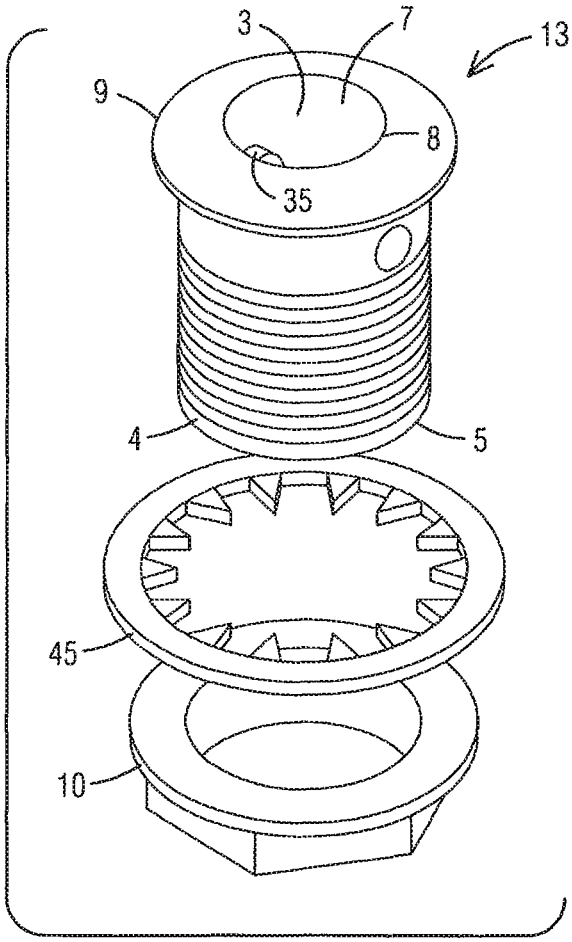
Figure 27:
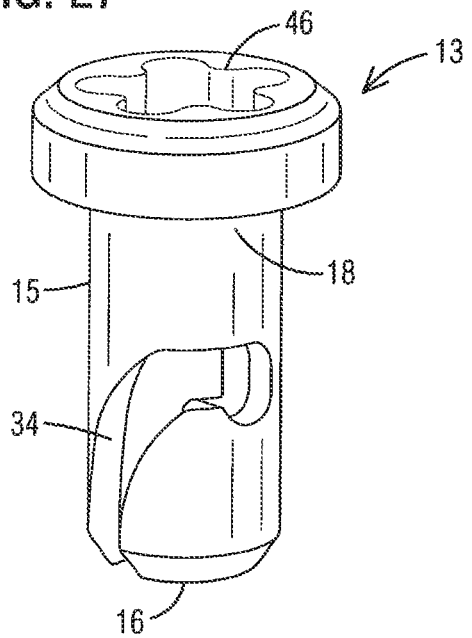
Figure 28:
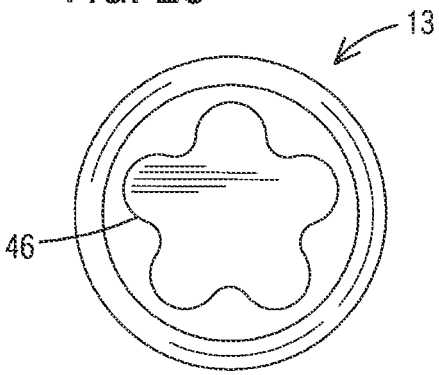
Figure 29:
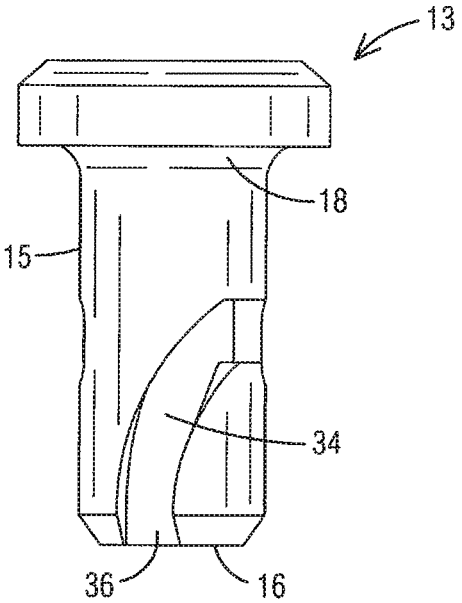
Figure 30:
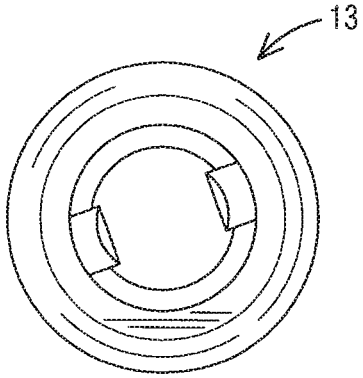
Figure 31:
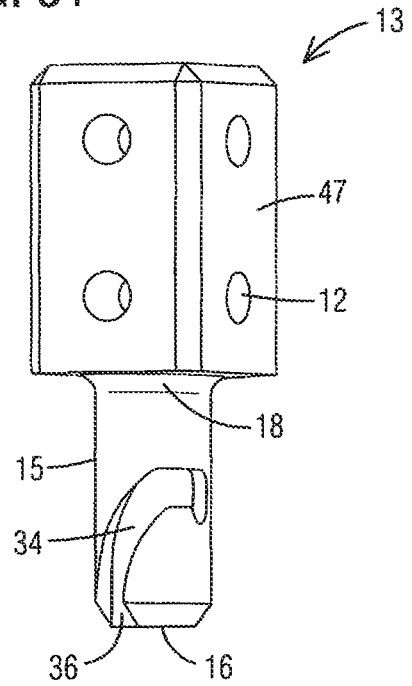
Figure 32:
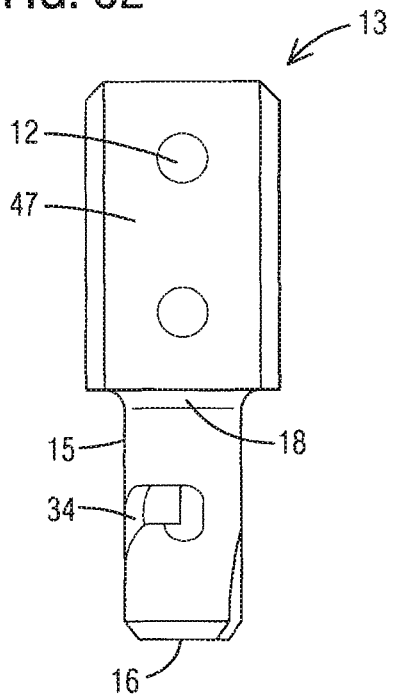
Figure 33:
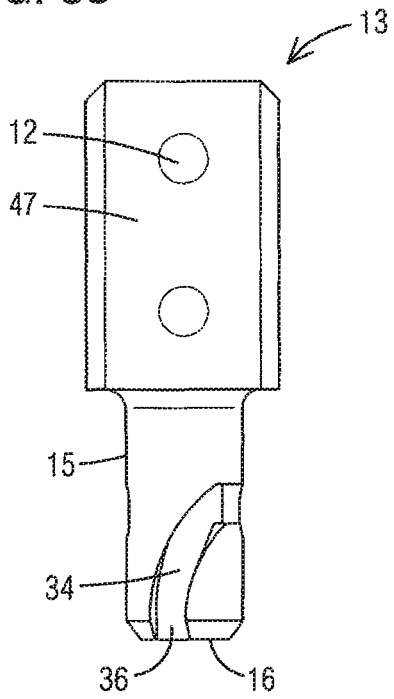
Figure 34:
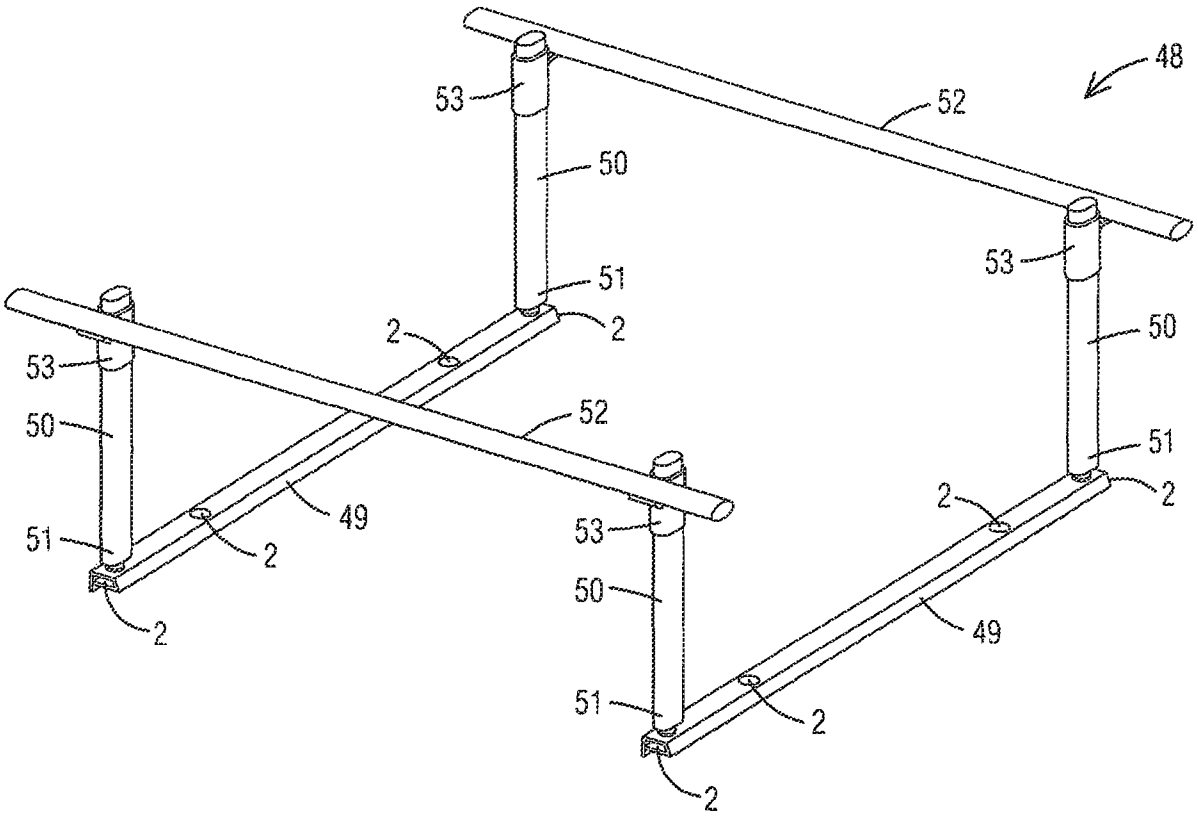
Figure 35:
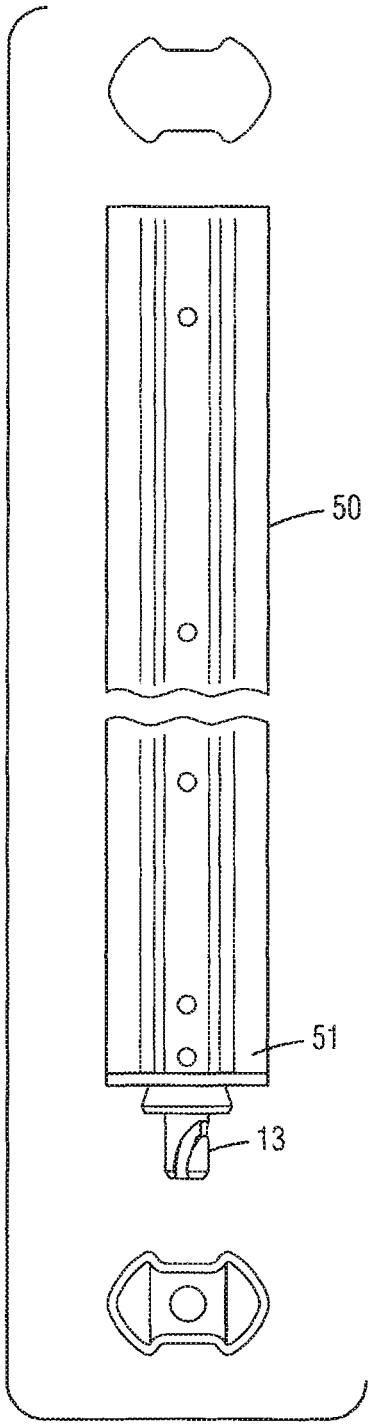
Figure 36:
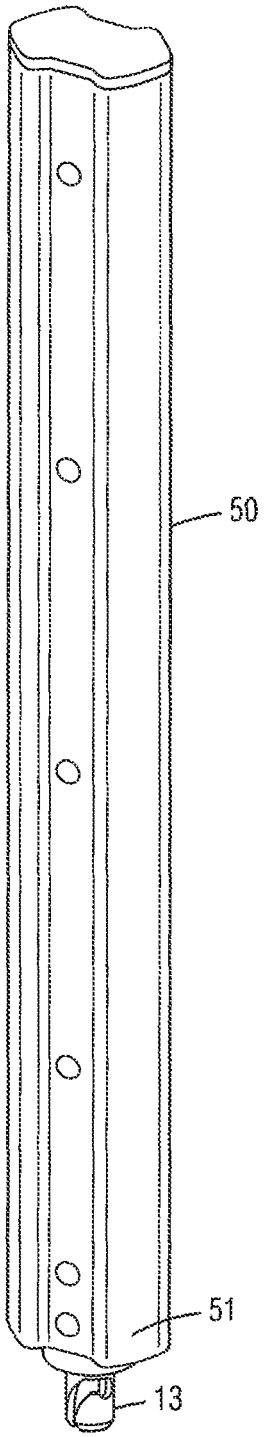
Figure 37:
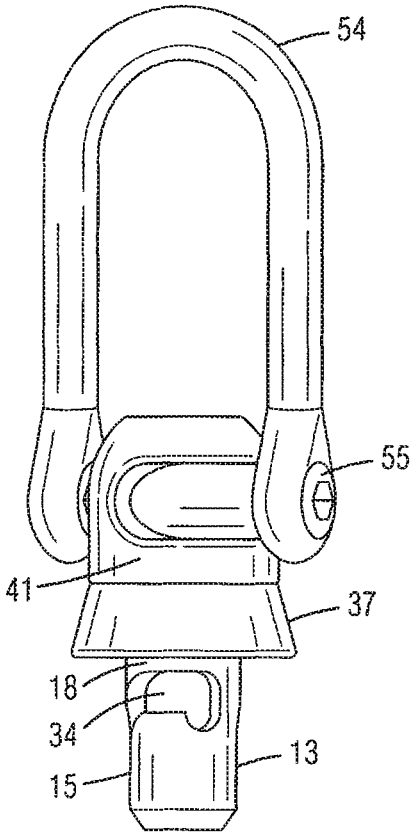
Figure 38:
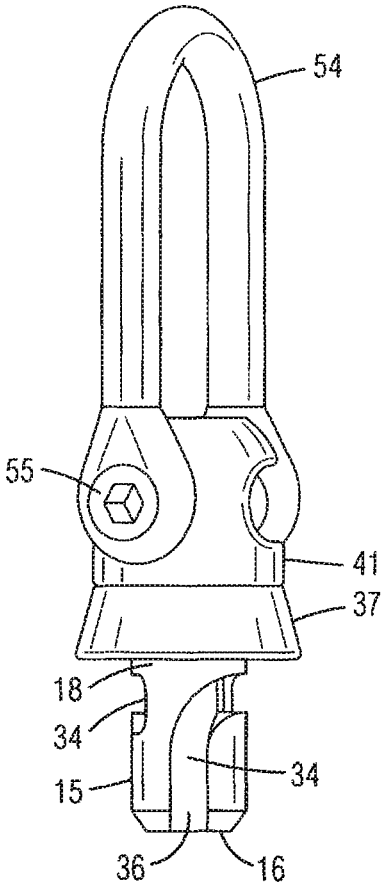
Figure 39:
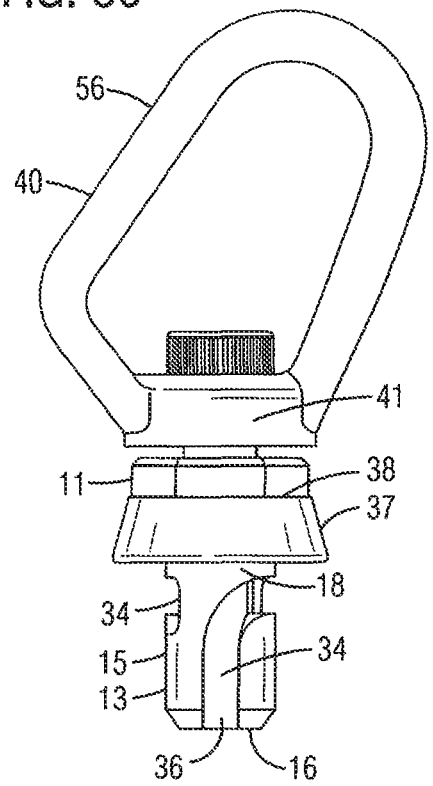
Figure 40:
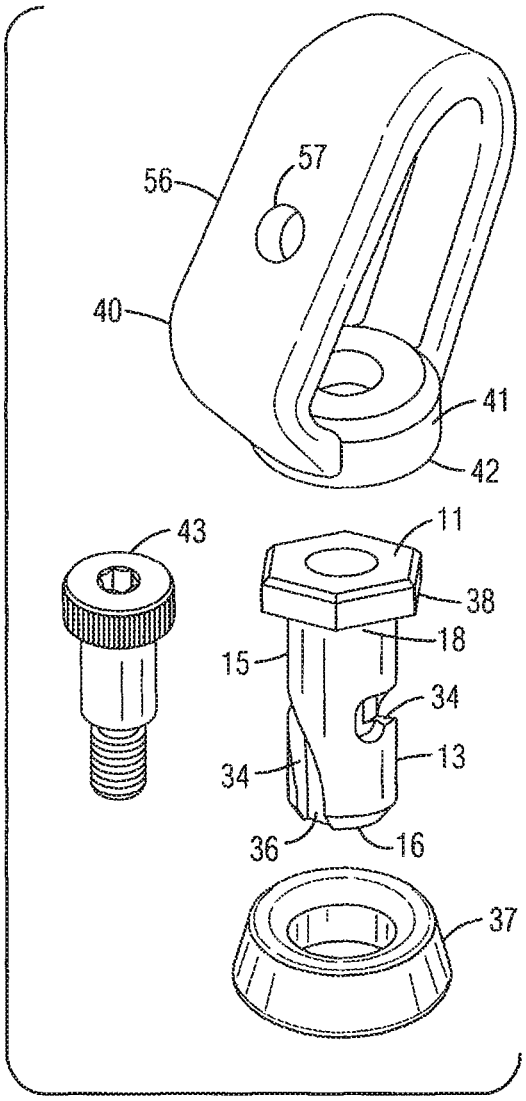
Figure 41:
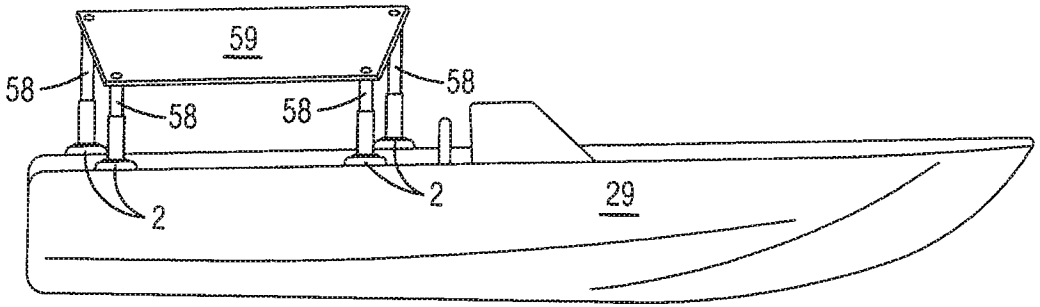
Figure 42:
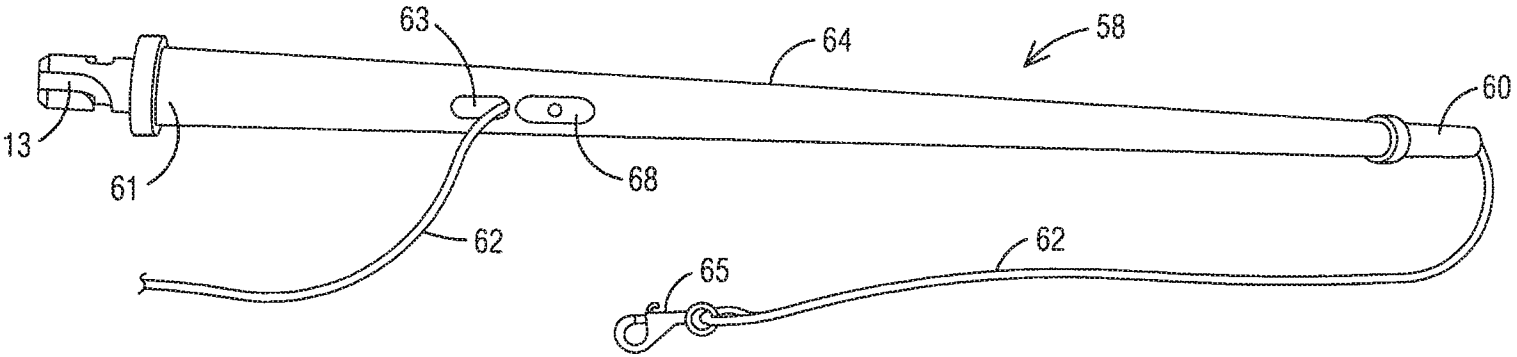

FIG, 4 is a side view of a boat having an accessory attached using the accessory attachment system of the present invention;

FIG. 5 is an internal view of the boat along line A-A of FIG. 4 showing a quick connect of the system of the present invention;

FIG. 6 is an exploded side view of a quick connect of the accessory attachment system of the present invention having a blind attachment means;

FIG. 7 is an exploded perspective side view of a quick connect of the accessory attachment system of the present invention having a blind attachment means;

FIG. 8 is a perspective side view of a quick connect of the present invention is illustrated wherein the stud and socket connect to each other via channels arid pins;

FIG. 9 is an exploded perspective side view of a quick connect of the present invention is illustrated wherein the stud and socket connect to each other via channels and pins;

FIG. 10 is a top view of a stud of the present invention wherein the mounting surface has a geometric shape;

FIG. 11 is a side view of a stud of the present invention wherein the mounting surface has a geometric shape;

FIG. 12 is a sectional side view along line B-B of FIG. 11 of a stud of the present invention wherein the mounting surface has a geometric shape;

FIG. 13 is a side perspective view of a stud of the present invention wherein the mounting surface has a geometric shape;

FIG. 14 is a perspective top view of a compression ring of the present invention;

FIG. 15 is a perspective bottom view of a compression ring of the present invention;

FIG. 16 is a bottom view of a compression ring of the present invention;

FIG. 17 is a side view of a compression ring of the present invention;

FIG. 18 is a sectional side view along line A-A of FIG. 17 of a compression ring of the present invention;

FIG. 19 is a perspective top view of a socket of the present invention;

FIG. 20 is a side plan view of the socket of the present invention;

FIG. 21 is an alternate side plan view of the socket of the present invention;

FIG. 22 is a sectional side view along line B-B of FIG. 21 of the socket of the present invention;

FIG. 23 is a perspective top view of a bolt-on socket of the present invention;

FIG. 24 is an exploded perspective top view of a bolt-on socket of the present invention;

FIG. 25 is a perspective top view of a threaded socket of the present invention;

FIG. 26 is an exploded perspective top view of a threaded socket of the present invention;

FIG. 27 is a perspective top view of a socket of the present invention having a keyed aperture;

FIG. 28 is a top view of a socket of the present invention having a keyed aperture;

FIG. 29 is a side view of a socket of the present invention having a keyed aperture;

FIG. 30 is a bottom view of a socket of the present invention having a keyed aperture;

FIG. 31 is a perspective side view of a socket of the present invention having a support post;

FIG. 32 is a side view of a socket of the present invention having a support post;

FIG. 33 is an alternate side view of a socket of the present invention having a support post;

FIG. 34 is a perspective top view of a utility rack of the present invention;

FIG. 35 is a side view of an upright form a utility rack of the present invention;

FIG. 36 is a perspective side view of an upright form a utility rack of the present invention;

FIG. 37 is a side view of a shackle extending upward from a stud of the present invention;

FIG. 38 is an opposing side view of a shackle extending upward from a stud of the present invention;

FIG. 39 is a side view of a tie down mount assembly of the present invention;

FIG. 40 is a perspective exploded view of a tie down mount assembly of the present invention;

FIG. 41 is a side view of a boat a plurality of canopy support poles attached to the boat and supporting a canopy; and FIG. 42 is a side plan view of a canopy support pole of the present invention.

DESCRIPTION OF THE PREFERRED EMBODIMENTS

For purposes of describing the preferred embodiment, the terminology used in reference to the numbered accessories in the drawings is as follows:

1. quick connect
2. socket
3. inner surface of socket
4. outer surface of socket
5. bottom edge of socket
6. bottom opening of socket
7. top edge of socket
8. top opening of socket
9. flange
10. socket nut
11. mounting surface
12. aperture
13. stud
14. inner surface of stud
15. outer surface of stud
16. bottom edge of stud
17. bottom opening of stud
18. top end of stud
19. bracket
20. pad
21. top surface of pad
22. bottom surface of pad
23. attachment bolt
24. distal end of attachment bolt
25. proximal end of attachment bolt
26. grip
27. collar
28. U-shaped attachment bracket
29. boat
30. accessory
31. arch
32. leg
33. end of leg
34. channel
35. pin
36. opening of channel
37. compression ring
38. lip
39. tie down
40. loop
41. base of tie down
42. bottom surface of base
43. bolt
44. mounting plate
45. washer
46. keyed aperture
47. support post
48. utility rack
49. bed rail cap
50. upright
51. bottom end of upright
52. crossbar
53. sleeve
54. shackle
55. pin
56. tie down mount
57. aperture
58. canopy support pole
59. canopy
60. top end of canopy support pole
61. bottom end of canopy support pole
62. cord
63. opening
64. side wall
65. clip
66. top end of canopy support pole
67. bottom end of canopy support pole
68. cleat With reference to FIGS. 1 and 2, an exploded perspective side view and a sectional side view, respectively, of a quick connect 1 of the accessory attachment system of the present invention are illustrated. The quick connect 1 of the present invention comprises a tubular socket 2 having an inner surface 3, a threaded outer surface 4, a bottom edge 5 surrounding a bottom opening 6, a top edge 7 surrounding a top opening 8 and a flange 9 extending outward from the top edge 7. A socket nut 10 engages the threaded outer surface 4 of the socket 2 to secure the socket 2 to a mounting surface 11, such as a boat deck or surface of a vehicle, by placing the socket 2 through an aperture 12 in the mounting surface 11 and then sandwiching the mounting surface 11 between the socket nut 10 and the flange 9.

Figure 1:
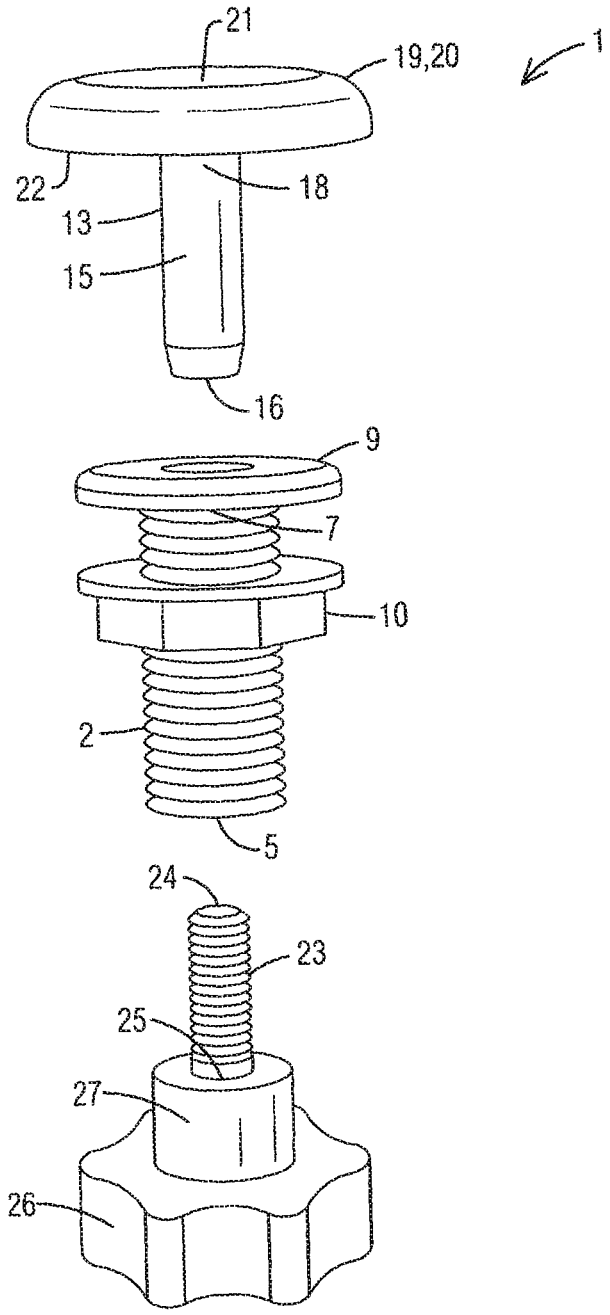
FIG. 1 is an exploded perspective side view of a quick connect of the accessory attachment system of the present invention.
Figure 2:
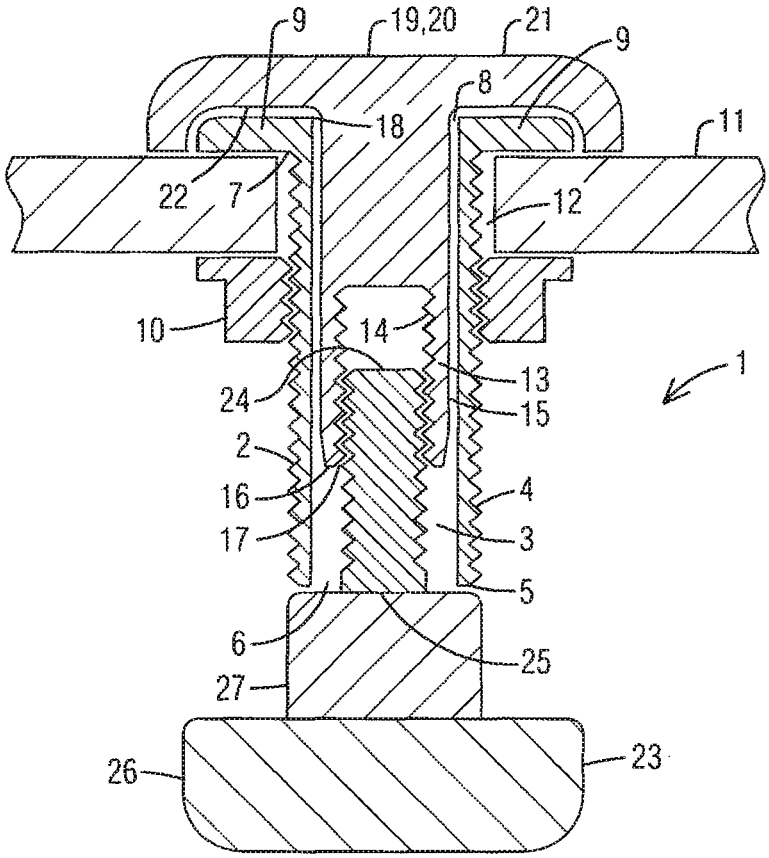
FIG. 2 is a sectional side view of a quick connect of the accessory attachment system of the present invention installed on a mounting surface.

Accessories are secured to at least one stud 13 that is inserted into the socket 2 in order to secure an accessory to a boat or vehicle to which the at least one socket 2 is attached. The stud 13 comprises a threaded inner surface 14, an outer surface 15, a bottom edge 16 surrounding a bottom opening 17, a top end 18 and an attachment bracket 19 extending from the top end 18. As illustrated in FIGS. 1 and 2, the attachment bracket 19 is a circular-shaped attachment pad 20 having a top surface 21 to which an accessory may be attached via welding or other attachment means. A bottom surface 22 of the pad 20 is preferably partially recessed to allow the flange 9 of the socket 2 to be fully covered by the pad 20, as illustrated in FIG. 2.

The stud 13 and socket 2 may have any corresponding geometric shape. As illustrated herein, each have a circular shape, however, each may have other geometric shapes, such as a rectangular, triangular, star, hexagonal, octagonal and so forth.

The stud 13 is secured within the socket 2 via a threaded attachment bolt 23 having a distal end 24 that is inserted through the bottom opening 6 of the socket 2 and engages the threaded inner surface 14 of the stud 13. The threaded attachment bolt 23 preferably has a grip 26 located on a proximal end 25 used for turning the threaded attachment bolt 23 and a collar 27 located below the grip 26 that engages the bottom edge 5 of the socket 2 to further secure the stud 13 within the socket 2.

Figure 3:
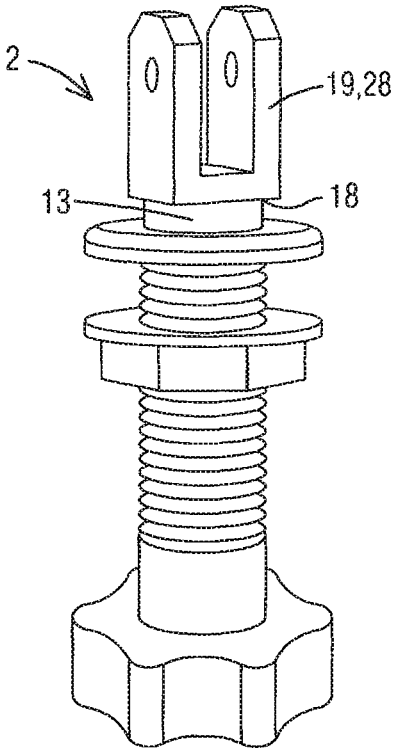
FIG. 3 is a perspective side view of a quick connect of the accessory attachment system of the present invention wherein the attachment bracket is a U-shaped attachment bracket.

With reference to FIG. 3, a perspective side view of a quick connect 2 of the accessory attachment system of the present invention wherein the attachment bracket 19 is a U-shaped attachment bracket 28 is illustrated. The stud 13 comprises a top end 18 and a bracket 19 extending from the top end 18 wherein the bracket is a U-shaped attachment bracket 28 to which an accessory may be attached using a pine or rivet.

With reference to FIGS. 4 and 5, a side view of a boat 29 having an accessory 30 attached using the accessory attachment system of the present invention and an internal view of the boat 29 along line A-A of FIG. 4 showing a quick connect 2 of the system of the present invention, respectively, are illustrated. The accessory 30 is a support arch 31 secured to a deck mounting surface 11 of the boat 29 using a plurality of quick connects 2. The arch 31 comprises legs 32 having ends 33 attached to attachment brackets 18, which are pads 20, of the quick connect 2 via welding or other attachment means. The legs 32 of the arch 31 are secured to the sockets 2 of the quick connects 1 by inserting the studs 13 into the corresponding sockets 2 and then securing the tubular shaped studs within the sockets 2 using threaded bolts.

With reference to FIGS. 6 and 7, an exploded side view and exploded side perspective view, respectively, of a quick connect 1 of the accessory attachment system of the present invention having a blind attachment means 55 is illustrated. The quick connect 1 of the present invention comprises a tubular socket 2 having an inner surface 3, a bottom edge 5 surrounding a bottom opening 6, a top edge 7 surrounding a top opening 8 and a flange 9 extending outward from the top edge 7. At least one blind attachment means 55, such as a button clip 56 or similar retractable projection 57, is located on the perimeter wall of the tubular socket a predetermined distance from the flange 9. To secure the socket 2 to a mounting surface 11, such as a boat deck or surface of a vehicle, the socket 2 is placed through an aperture 12 in the mounting surface 11 while the at least one blind attachment means 55 is in a retracted position. When fully inserted into the aperture 12, the blind attachment means 55 is released from the retracted position causing the mounting surface 11 to be sandwiched between the blind attachment means 55 and the flange 9.

As illustrated in FIG. 6, the stud 13 may be secured within the socket 2 via at least one blind attachment means 55, such as a button clip 56 or similar retractable projection 57 that engages an aperture located on the stud 13 or the bottom edge 5 of the socket 2.

As illustrated in FIG. 7, the stud 13 may be secured within the socket 2 via at least one blind attachment means 55, such as a button clip 56 or similar retractable projection 57 that engages an aperture or groove 58 located on the stud.

With reference to FIGS. 8 and 9, a quick connect 1 of the present invention is illustrated wherein the stud 13 and socket 2 connect to each other via channels 34 and pins 35 is illustrated. The quick connect 1 comprises a tubular-shaped socket 2 having an inner surface 3, an outer surface 4, a bottom edge 5 surrounding a bottom opening 6, a top edge 7 surrounding a top opening 8 and a flange 9 extending outward from the top edge 7. Pins 35, as illustrated in FIGS. 20-22, extend from the inner surface 3 of the socket 2 on opposing sides of the socket 2. The quick connect 1 further comprises a stud 13 that is inserted into the socket 2 in order to secure an accessory to a surface to which the at least one socket 2 is attached. As further illustrated in FIGS. 10-13, the stud 13 comprises an elongated cylindrical shaped body having, an outer surface 15, a bottom edge 16, a top end 18 and substantially J-shaped channels 34 located on the outer surface 15. The J-shaped channels 34 have an opening 36 located on the bottom edge 16 of the stud 13. The channels then extend upward toward the top end 18 of the stud 13 and curving or turning back toward the bottom edge 16 of the stud 13. The stud 13 further comprises a compression ring 37, as further illustrated in FIGS. 14-18, located on the top end 18 of the cylindrical body of the stud 13 below a mounting surface 11 that extends outward from the outer surface 15 of the cylindrical body of the stud 13, thereby creating a lip 38 that prevents the compression ring from sliding off the top end 18 of the stud 13. The compression ring 37 may be constructed out of a rubber or equivalent material that provides resilience, such as a spring. As illustrated herein, the mounting surface 11 is hexagon-shaped to allow the stud 13 to be easily turned while pressing the stud 13 into the socket 2.

To couple the stud 13 and the socket 2, the pins 35 on the stud 13 are aligned with the openings 36 of the channels 34 and the stud 13 is pushed into the socket 2, thereby compressing the compression ring 37 between the flange 9 of the socket 2 and the lip 38 of the stud 13. After the pins 35 reach the bottom of the channels 34, the stud 13 is rotated so the pins slide along curved portions of the channels 34 and reach serifs 39 located at ends of the channels 34. The compression ring 37 then pushes the stud 13 away from the socket 2 to keep the pins 35 locked in the serifs 39.

As further illustrated in FIGS. 8 and 9, the accessory 30 attached to the stud 13 is a tie down 39 comprising a circular-shaped loop 40 extending from a base 41 having a concave hexagon-shaped bottom surface 42 that engages the hexagon-shaped mounting surface 11. The mounting surface 11 and base 41 may have any corresponding geometric shapes. The tie down 39 is attached to the mounting surface 11 via a partially threaded bolt 43 that allows the tie down 39 to freely rotate in relation to the stud. Conversely, the tie down may be pushed downward to engage the mounting surface 11 and stud 13 when rotating the stud 13 within the socket 2.

With reference to FIGS. 19-22, a socket 13 of the present invention is illustrated wherein the socket 2 comprises an inner surface 3, an outer surface 4, a bottom edge 5 surrounding a bottom opening 6, a top edge 7 surrounding a top opening 8 and a flange 9 extending outward from the top edge 7. Pins 35 extend from the inner surface 3 of the socket 2 on opposing sides of the socket 2. The socket 2 may be attached to a surface via an attachment means, such as welding.

With reference to FIGS. 23 and 24, a bolt-on socket 13 of the present invention is illustrated wherein the socket 2 comprises an inner surface 3, an outer surface 4, a bottom edge 5, a top edge 7 surrounding a top opening 8 and a flange 9 extending outward from the top edge 7. Pins 35 extend from the inner surface 3 of the socket 2 on opposing sides of the socket 2. The socket 2 may be attached to a surface via bolts 43 that engage the flange 9 and nuts or a mounting plate 44.

With reference to FIGS. 25 and 26, a threaded socket 13 of the present invention is illustrated wherein the socket 2 comprises an inner surface 3, an outer surface 4, a bottom edge 5, a top edge 7 surrounding a top opening 8 and a flange 9 extending outward from the top edge 7. Pins 35 extend from the inner surface 3 of the socket 2 on opposing sides of the socket 2. The outer surface 4 of the socket 2 is threaded so that it may be attached to a surface via a nut 10 and washer 45.

With reference to FIGS. 27-30, a stud 13 having a keyed aperture 46 and comprising an elongated cylindrical shaped body having, an outer surface 15, a bottom edge 16, a top end 18 and substantially J-shaped channels 34 located on the outer surface 15. The J-shaped channels 34 have an opening 36 located on the bottom edge 16 of the stud 13. The channels then extend upward toward the top end 18 of the stud 13 and curving or turning back toward the bottom edge 16 of the stud 13. The keyed aperture 46 is located on the top end 18 of the stud 13 and allows accessories having similarly keyed male posts to be attached to the stud 13.

With reference to FIGS. 31-33, a stud 13 having a support post 47 is illustrated. The stud 13 comprises an elongated cylindrical shaped body having, an outer surface 15, a bottom edge 16, a top end 18 and substantially J-shaped channels 34 located on the outer surface 15. The J-shaped channels 34 have an opening 36 located on the bottom edge 16 of the stud 13. The channels then extend upward toward the top end 18 of the stud 13 and curving or turning back toward the bottom edge 16 of the stud 13. The support post 47 is located on the top end 18 of the stud 13 and comprises a rectangular-shaped body having apertures 12 located thereon for locking an accessory to the support post 47.

With reference to FIGS. 34-36, a utility rack 48 that incorporates quick connects 1 of the present invention is illustrated. The utility rack 48 comprises bed rail caps 49 that attach to bed rails of a pickup truck. Each bed rail cap 49 comprises an elongated member having a plurality of sockets 2 spaced apart along the length thereof. The sockets 2 provide attachment points for uprights 50. The uprights 50 comprises elongated members having studs 13 extending from the bottom ends 51 thereof. The studs 13 engage the sockets 2 of the bed rail caps 49 to lock the uprights 50 in vertical positions in relation to the bed rail caps 49. Crossbars 52 attach to the uprights 50 via sleeves 53 that allow the height of the crossbars 52 to be adjusted in relation to the uprights 50.

With reference to FIGS. 37 and 38, a side view and opposing side view, respectively, of a shackle 54 extending upward from a stud 13 of the present invention are illustrated. The stud 13 comprises an elongated cylindrical shaped body having, an outer surface 15, a bottom edge 16, a top end 18 and substantially J-shaped channels 34 located on the outer surface 15. The J-shaped channels 34 have an opening 36 located on the bottom edge 16 of the stud 13. The channels then extend upward toward the top end 18 of the stud 13 and curving or turning back toward the bottom edge 16 of the stud 13. The stud 13 further comprises a compression ring 37 located on the top end 18 of the cylindrical body of the stud 13. The accessory 30 attached to the stud 13 is a shackle 54 comprising a substantially U-shaped loop 40 extending from a base 41 and connected to the base by a pin 55.

With reference to FIGS. 39 and 40, a side view and perspective exploded view of a tie down mount 56 extending upward from a stud 13 of the present invention are illustrated. The stud 13 comprises an elongated cylindrical shaped body having, an outer surface 15, a bottom edge 16, a top end 18 and substantially J-shaped channels 34 located on the outer surface 15. The J-shaped channels 34 have an opening 36 located on the bottom edge 16 of the stud 13. The channels then extend upward toward the top end 18 of the stud 13 and curving or turning back toward the bottom edge 16 of the stud 13. The stud 13 further comprises a compression ring 37 on the top end 18 of the cylindrical body of the stud 13 below a mounting surface 11 that extends outward from the outer surface 15 of the cylindrical body of the stud 13, thereby creating a lip 38 that prevents the compression ring from sliding off the top end 18 of the stud 13. As illustrated herein, the mounting surface 11 is hexagon-shaped to allow the stud 13 to be easily turned while pressing the stud 13 into the socket 2.

The accessory 30 attached to the stud 13 is a tie down mount 56 comprising a loop 40 having an aperture 57 located thereon for attaching a retractable tie down, such as a winch, ratcheting tie down and so forth. The loop 40 extends from a base 41 having a concave hexagon-shaped bottom surface 42 that engages the hexagon-shaped mounting surface 11. The mounting surface 11 and base 41 may have any corresponding geometric shapes. The tie down mount 56 is attached to the mounting surface 11 via a partially threaded bolt 43 that allows the tie down mount 56 to freely rotate in relation to the stud. Conversely, the loop 40 may be pushed downward to engage the mounting surface 11 and stud 13 when rotating the stud 13 within the socket 2.

With reference to FIGS. 41 and 42, a side view of a boat 29 having a plurality of canopy support poles 58 attached to the boat 29 and supporting a canopy 59 using the accessory attachment system of the present invention and a side plan view of a canopy support pole 58 of the present invention, respectively, are illustrated. Sockets 2 provide attachment points for canopy support poles 58 that extend upward to a desire height to support a canopy 59, which provides shade over the boat 29 or other surface, structure or object having sockets 2 mounted thereon.

The canopy support poles 58 are each preferably telescoping to allow the height of the canopy 59 to be adjusted. For example, one side of the canopy 59 may be made lower to provide additional shade from the sun in the early morning or in the late afternoon sun.

Each canopy support pole 58 comprises a top end 60 and a bottom end 61. A stud 13 is located on the bottom end 61 of the canopy support pole 58. The stud 13 connects to a corresponding socket 2 via channels 34 and pins 35, as previously illustrated. A cord 62 extends from said bottom end 61, preferably entering through an opening 63 located in a side wall 64 of the canopy support pole 58, through the canopy support pole 58 and preferably exiting through the top end 60 of the canopy support pole 58. An attachment clip 65 is located on a top end 66 of said cord 62. The attachment clip 65 may be secured to a corner or edge of the canopy 59 and then tightened by pulling a bottom end 67 of the cord 62. The cord 62 may be tightened or loosened as the height of the canopy support pole 58 is adjusted, thereby adjusting the tautness of the canopy 59. Finally, the cord 62 may be secured in place using a cleat 68 located on the canopy support pole 58.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention we claim:

1. An accessory attachment system comprising:

a tubular-shaped socket having an inner surface, an outer surface, a bottom edge surrounding a bottom opening, a top edge surrounding a top opening and a flange extending outward from the top edge;

at least one pin extending from the inner surface of the socket;

a stud having an elongated cylindrical-shaped body capable of being inserted into said socket;

said stud having an outer surface, a bottom edge, a top end and at least one channel located on the outer surface wherein said at least one channel engages said at least one pin when said stud is inserted into said socket; and an accessory extending from said top end of said stud wherein said accessory is removeably attachable to said socket via said at least one stud wherein, said at least one channel located on said outer surface of said stud is a J-shaped channel having an opening located on the bottom edge of said stud; and said J-shaped channel extending upward toward the top end of said stud and turning back toward the bottom edge of the stud.

2. The accessory attachment system of claim 1 further comprising:

a mounting surface located on the top end of said stud.

3. The accessory attachment system of claim 1 wherein:

said accessory being a loop extending upward from the top end of said stud.

4. The accessory attachment system of claim 3 wherein:

said loop having an aperture located thereon.

5. The accessory attachment system of claim 1 wherein:

said accessory being a tie down extending upward from the top end of said stud.

6. The accessory attachment system of claim 1 wherein:

said accessory being a shackle extending upward from the top end of said stud.

7. The accessory attachment system of claim 1 wherein:

said accessory being a tie down mount extending upward from the top end of said stud.

8. An acccessory attachment system comprising:

a tubular-shaped socket having an inner surface, an outer surface, a bottom edge surrounding a bottom opening, a top edge surrounding a top opening and a flange extending outward from the top edge;

at least one pin extending from the inner surface of the socket;

a stud having an elongated cylindrical-shaped body capable of being inserted into said socket;

said stud having an outer surface, a bottom edge, a top end and at least one channel located on the outer surface wherein said at least one channel engages said at least one pin when said stud is inserted into said socket;

an accessory extending from said top end of said stud wherein said accessory is removeably attachable to said socket via said at least one stud; and a compression ring located on the top end of said stud.

9. The accessory attachment system of claim 8 further comprising:

a mounting surface located on the top end of said stud above said compression ring; and said mounting surface extending outward from the outer surface of the cylindrical body of the stud thereby creating a lip that prevents the compression ring from sliding off the top end of the stud.

10. The accessory attachment system of claim 9 wherein:

said mounting surface engages a base having a concave bottom surface with a geometric shape that corresponds to a shape of said mounting surface; and said base being located between said mounting surface and said accessory.

11. The accessory attachment system comprising:

a tubular-shaped socket having an inner surface, an outer surface, a bottom edge surrounding a bottom opening, a top edge surrounding a top opening and a flange extending outward from the top edge;

at least one pin extending from the inner surface of the socket;

a stud having an elongated cylindrical-shaped body capable of being inserted into said socket;

said stud having an outer surface, a bottom edge, a top end and at least one channel located on the outer surface wherein said at least one channel engages said at least one pin when said stud is inserted into said socket; and an accessory extending from said top end of said stud wherein said accessory is removeably attachable to said socket via said at least one stud, said accessory being an upright extending upward from the top end of said stud and supporting a crossbar.

12. The accessory attachment system comprising:

a tubular-shaped socket having an inner surface, an outer surface, a bottom edge surrounding a bottom opening, a top edge surrounding a top opening and a flange extending outward from the top edge;

at least one pin extending from the inner surface of the socket;

a stud having an elongated cylindrical-shaped body capable of being inserted into said socket;

said stud having an outer surface, a bottom edge, a top end and at least one channel located on the outer surface wherein said at least one channel engages said at least one pin when said stud is inserted into said socket; and an accessory extending from said top end of said stud wherein said accessory is removeably attachable to said socket via said at least one stud, said accessory being a canopy support pole extending upward from the top end of said stud.

13. The accessory attachment system of claim 12 wherein:

said canopy support pole having a top end and a bottom end;

said canopy support pole being telescoping;

a cord extending through the canopy support pole and exiting the top end of the canopy support pole; and an attachment clip for attaching the top end of the cord to a canopy.

14. The accessory attachment system of claim 13 wherein:

a cleat located on the canopy support pole for securing said cord in a desired position.

* * * * *